US007581620B2

(12) United States Patent
Woods et al.

(10) Patent No.: US 7,581,620 B2
(45) Date of Patent: Sep. 1, 2009

(54) MARINE MUFFLER WITH ANGULARLY DISPOSED INTERNAL BAFFLE

(76) Inventors: Woodrow Woods, 3640 Fiscal Ct., Riviera Beach, FL (US) 33404; Darrin Woods, 3640 Fiscal Ct., Riviera Beach, FL (US) 33404; Craig McLeod, 3640 Fiscal Ct., Riviera Beach, FL (US) 33404

( * ) Notice: Subject to any disclaimer, the term of this patent is extended or adjusted under 35 U.S.C. 154(b) by 0 days.

(21) Appl. No.: 11/891,481

(22) Filed: Aug. 10, 2007

(65) Prior Publication Data

US 2008/0035422 A1 Feb. 14, 2008

Related U.S. Application Data

(60) Provisional application No. 60/837,350, filed on Aug. 10, 2006.

(51) Int. Cl.

| | |
|---|---|
| ***F01N 1/08*** | (2006.01) |
| ***F16L 55/04*** | (2006.01) |
| *F01N 1/02* | (2006.01) |
| *F16L 55/053* | (2006.01) |

(52) U.S. Cl. ..... 181/264; 181/272; 181/281; 181/233

(58) Field of Classification Search ..... 181/264, 181/269, 272, 281, 233, 234, 235, 275, 258, 181/259, 260

See application file for complete search history.

(56) References Cited

U.S. PATENT DOCUMENTS

| | | | | | |
|---|---|---|---|---|---|
| 1,028,847 | A | * | 6/1912 | Snyder | 181/264 |
| 2,019,746 | A | * | 11/1935 | Tatter | 181/281 |
| 2,169,359 | A | * | 8/1939 | Jones et al. | 181/233 |
| 2,216,763 | A | * | 10/1940 | Boyce | 96/386 |
| 2,328,161 | A | * | 8/1943 | Maxim | 181/260 |
| 2,360,429 | A | * | 10/1944 | Leadbetter | 181/260 |
| 2,718,274 | A | * | 9/1955 | Kimbal | 181/264 |
| 2,933,148 | A | * | 4/1960 | Hendry | 181/246 |
| 3,033,306 | A | * | 5/1962 | Hallene et al. | 181/233 |
| 4,192,404 | A | * | 3/1980 | Nakagawa et al. | 181/272 |
| 4,305,477 | A | * | 12/1981 | Moore | 181/249 |
| 4,416,350 | A | * | 11/1983 | Hayashi | 181/272 |
| 4,605,092 | A | * | 8/1986 | Harris et al. | 181/280 |
| 4,778,029 | A | * | 10/1988 | Thornburgh | 181/229 |
| 4,917,640 | A | * | 4/1990 | Miles, Jr. | 440/89 R |

(Continued)

FOREIGN PATENT DOCUMENTS

| | | | |
|---|---|---|---|
| JP | 05098939 | A * | 4/1993 |

*Primary Examiner*—Edgardo San Martin
(74) *Attorney, Agent, or Firm*—Malin Haley; DiMaggio Bowen & Lhota, P.A.

(57) ABSTRACT

A marine muffler comprises an elongate cylindrical housing having an inlet and an outlet and defining an internal volume partitioned, by an angularly disposed internal baffle, into a lower chamber in communication with the inlet and an upper chamber in communication with the outlet. A vertically disposed duct is insertably secured to the baffle to allow exhaust gas and exhaust cooling water to flow from the lower inlet chamber to upper outlet chamber. The exhaust duct may preferably be further adapted with internal structure forming a plurality of individual flow conduits or passages. The duct is preferably positioned such that a plurality of flow passage inlets are positioned in proximity to the lower cylindrical housing wall, with flow passage outlets positioned in proximity to the upper housing wall. The lower duct wall may further be adapted with sidewall apertures for improving exhaust flow dynamics therethrough.

14 Claims, 3 Drawing Sheets

U.S. PATENT DOCUMENTS 4,918,917 A 4/1990 Woods
5,145,026 A * 9/1992 Wilder ..... 181/233
5,196,655 A 3/1993 Woods
5,228,876 A 7/1993 Woods
5,262,600 A 11/1993 Woods
5,285,026 A * 2/1994 Lemetyinen ..... 181/224
5,326,942 A * 7/1994 Schmid ..... 181/235
5,444,196 A 8/1995 Woods
5,492,195 A * 2/1996 Zink et al. ..... 181/264
5,504,280 A 4/1996 Woods
5,588,888 A * 12/1996 Magharious ..... 440/89 R
5,616,893 A 4/1997 Woods
5,625,173 A 4/1997 Woods
5,679,931 A * 10/1997 Furse et al. ..... 181/224
5,718,462 A 2/1998 Woods
5,740,670 A 4/1998 Woods
5,934,959 A 8/1999 Inman, Sr.
6,024,617 A * 2/2000 Smullin et al. ..... 440/89 R
6,035,633 A 3/2000 Woods
6,152,258 A 11/2000 Deavers
6,241,044 B1 * 6/2001 Nishiyama et al. ..... 181/272
6,393,835 B1 * 5/2002 Stoll et al. ..... 60/299
6,443,255 B1 9/2002 Shavender, Jr.
6,478,645 B1 * 11/2002 Allbright et al. ..... 440/89 R
6,564,901 B2 5/2003 Woods
6,591,939 B2 * 7/2003 Smullin et al. ..... 181/260
6,651,773 B1 * 11/2003 Marocco ..... 181/270

* cited by examiner

MARINE MUFFLER WITH ANGULARLY DISPOSED INTERNAL BAFFLE

CROSS REFERENCE TO RELATED APPLICATIONS

This application claims the benefit of provisional U.S. patent application Ser. No. 60/837,350, filed Aug. 10, 2006.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to exhaust systems and mufflers for use with internal combustion marine engines, and more particularly to an improved marine engine muffler having an inclined baffle assembly that provides improved exhaust and water handling capability and enhanced noise reduction.

2. Description of Related Art

Marine vessels are typically configured with a propulsion system having an internal combustion engine mounted internally within the vessel hull. Exhaust generated by the engine is commonly combined with cooling water and routed through exhaust conduit to the stern or rear of the vessel via one or more exhaust ducts for discharge through one or more exhaust ports formed in the transom. One or more silencers may be installed within the exhaust duct(s) to silence noise associated with the engine and exhaust gases.

A variety of structures are known in the background art for use in silencing marine exhaust noise. The present inventor has invented a number of novel marine exhaust components that have greatly improved the silencing and efficiency of marine exhaust systems. Among those inventions developed by a named inventor for the present invention are the following:

| U.S. Pat. No. | Entitled |
|---|---|
| 4,918,917 | Liquid Cooled Exhaust Flange |
| 5,196,655 | Muffler for Marine Engines |
| 5,228,876 | Marine Exhaust System Component Comprising a Heat Resistant Conduit |
| 5,262,600 | In-line Insertion Muffler for Marine Engines |
| 5,444,196 | In-line Insertion Muffler for Marine Engines |
| 5,504,280 | Muffler for Marine Engines |
| 5,616,893 | Reverse Entry Muffler With Surge Suppression Feature |
| 5,625,173 | Single Baffle Linear Muffler for Marine Engines |
| 5,718,462 | Muffler Tube Coupling With Reinforcing Inserts |
| 5,740,670 | Water Jacketed Exhaust Pipe for Marine Exhaust Systems. |
| 6,564,901 | Muffler for Marine Engine |

In U.S. Pat. No. 5,262,600, the first named inventor herein disclosed an in-line insertion muffler for marine engines employing a first housing encompassing a second housing which is partitioned by an angularly disposed inner planar baffle that has proven extremely effective in reducing engine noise. In U.S. Pat. No. 5,444,196, the first named inventor herein disclosed an improved version of the in-line muffler having a corrugated sleeve disposed between in the first and second housings. In U.S. Pat. No. 5,625,173, the first named inventor herein disclosed a single baffle linear muffler with an angularly disposed baffle that may be planer, convex, or concave.

The various linear mufflers made in accordance with the above-referenced patents have achieved tremendous success and widespread acceptance within the marine industry. Such muffler systems have been successfully installed on a wide variety of marine vessels having engines in excess of 1,000 horsepower. Current trends in marine vessel design, however, have resulted in reduced or very limited space availability for propulsion system components such as muffler systems. In addition, space limitations present in the retrofit and re-powering of existing marine vessels often present significant space limitations relating to the replacement of muffler systems. While the linear mufflers known in the art are suitable for a wide variety of marine applications, there exists a need for an improved linear muffler that is compact and suitable for use in high horsepower applications.

BRIEF SUMMARY OF THE INVENTION

The present invention overcomes limitations present in the art by providing an improved muffler for marine engines that is compact, and provides improved performance in terms of is silencing and backpressure characteristics, as well as ease of manufacturing and installation. A marine muffler comprises an elongate cylindrical housing having an inlet and an outlet and defining an internal volume partitioned by an angularly disposed internal baffle into a lower chamber in communication with said inlet and an upper chamber in communication with said outlet. The baffle is adapted with a vertically disposed duct to allow exhaust gas and exhaust cooling water to flow from the lower inlet chamber to upper outlet chamber. The exhaust duct may preferably be further adapted with internal structure forming a plurality of individual flow conduits or passages. The duct is preferably positioned such that a plurality of flow passage inlets are positioned in proximity to the lower cylindrical housing wall, with flow passage outlets positioned in proximity to the upper housing wall. The lower duct walls may further be adapted with sidewall apertures for improving exhaust flow dynamics through the duct.

Accordingly, it is an object of the present invention to provide a marine muffler adapted with an internal angularly disposed primary baffle.

Still another object of the present invention is to provide such a marine muffler wherein the baffle partitions the muffler into a lower inlet chamber and an upper outlet chamber.

Yet another object of the present invention is to provide such a muffler wherein the baffle is adapted with a duct in communication with said inlet and outlet chambers.

Still another object of the present invention is to provide such a muffler wherein the duct is partitioned into a plurality of sub-passages.

Yet another object of the present invention is to provide such a muffler the lower duct wall defines a plurality of apertures to improve water entrainment.

In accordance with these and other objects, which will become apparent hereinafter, the instant invention will now be described with particular reference to the accompanying drawings.

DETAILED DESCRIPTION OF THE INVENTION

Figure 1:
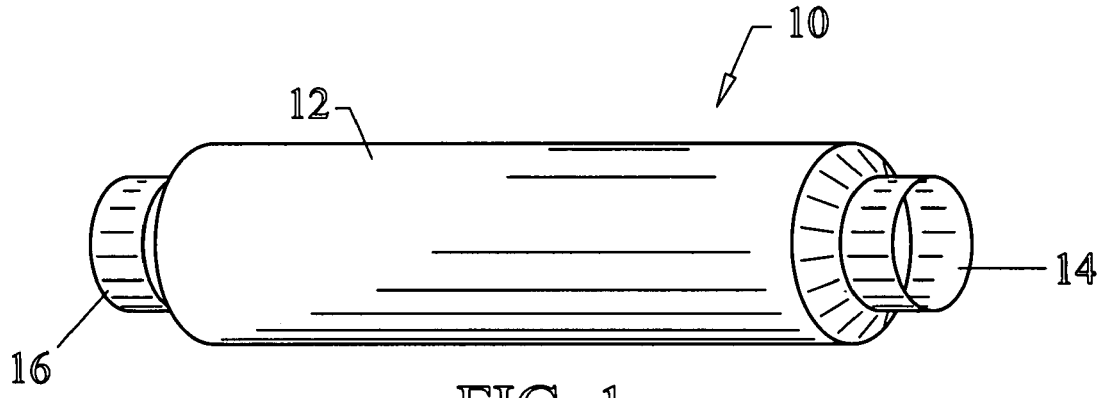
FIG. 1 is a perspective view of a marine engine muffler in accordance with the present invention.
Figure 2:
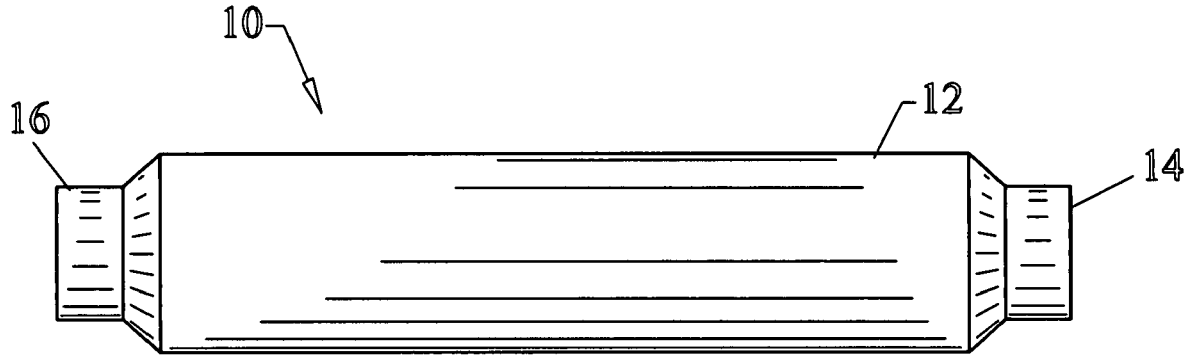
FIG. 2 is a side view thereof.
Figure 3:
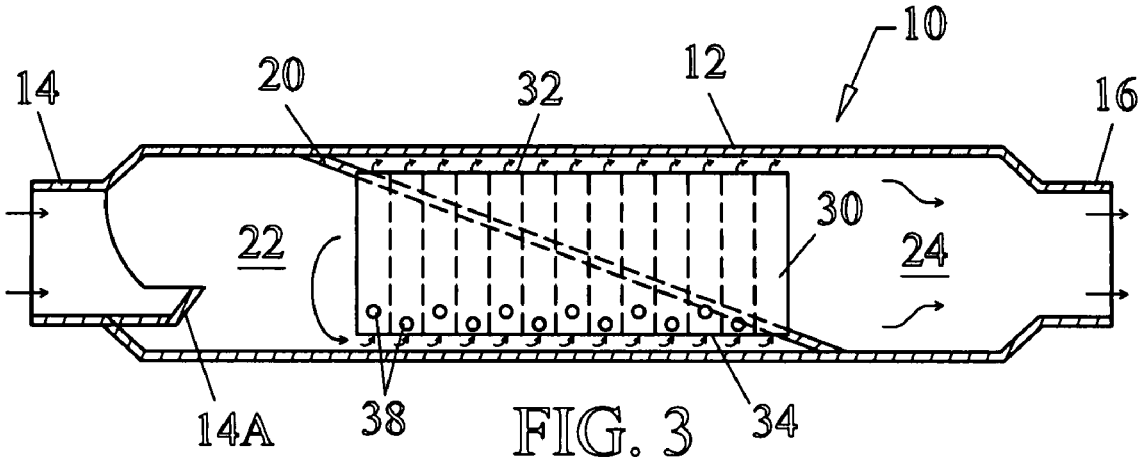
FIG. 3 is a sectional side view thereof.

With reference now to the drawings, FIGS. 1-5 depict a preferred embodiment of a muffler, generally referenced as 10, in accordance with the present invention. Muffler 10 is primarily characterized as having an elongate generally hollow muffler housing 12 formed about a longitudinal axis with opposing ends forming an open inlet 14 and an open outlet 16. In a preferred embodiment, housing 12 comprises a generally cylindrical structure fabricated from composite material such as temperature resistant fiberglass. While the preferred embodiment is disclosed with a housing that is generally cylindrical, the present invention is suitable for use with housings having various shapes. As best depicted in FIG. 3, muffler housing 12 defines an internal volume and includes an angularly disposed baffle 20, having a peripheral edge in sealing engagement with the inner surface of housing 12, which divides the internal volume into a lower inlet chamber 22 and an upper outlet chamber 24. In a preferred embodiment baffle 20 is generally planar, however, any suitable shape, such as concave or convex, is contemplated and considered within the scope of the present invention. Baffle 20 is angularly disposed and preferably oriented to extend angularly downward from an upper inner surface of housing 12 proximal muffler inlet 14 to a lower inner surface of housing 12 proximal muffler outlet 16. Accordingly, exhaust entering the muffler enters the inlet chamber 22, which chamber is defined by the lower surface of baffle 20 and the internal muffler housing wall. Inlet 14 may further be adapted with a generally upwardly angled lip 14A. Upwardly angled lip 14A functions to attenuate exhaust pressure waves while deflecting exhaust upward toward the underside of baffle 20.

Figure 4:
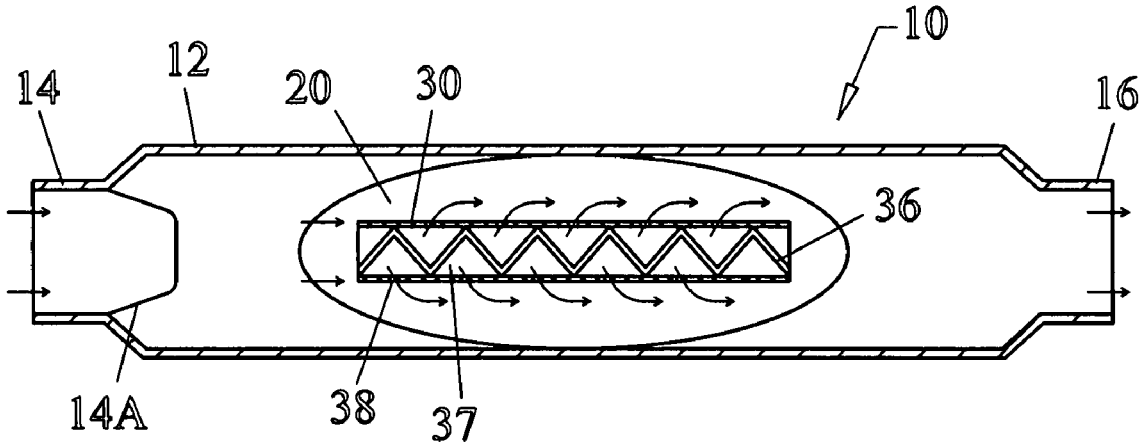
FIG. 4 is a top view with the housing shown in sectional view to reveal internal structure.
Figure 5:
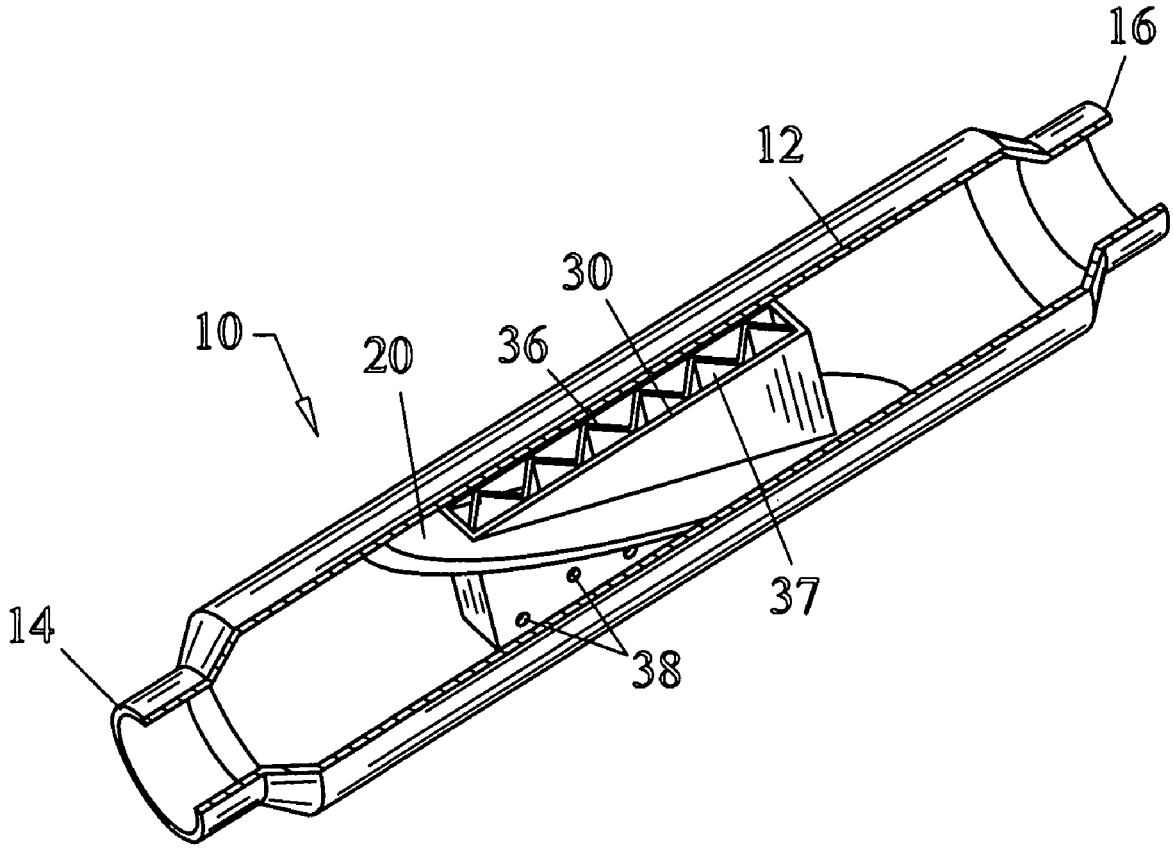
FIG. 5 is perspective sectional view thereof.

Secured to baffle 20 is a generally vertically disposed duct 30 having open top and bottom ends, referenced as 32 and 34 respectively, terminating in spaced relation with the inner surface of housing 12. Duct 30 functions to allow exhaust gas and cooling water entrained therewith to flow from the inlet chamber 22 to the outlet chamber 24. Duct 30 may preferably be further adapted with an internal wall structure 36 forming a plurality of individual flow conduits or passages, referenced as 37. In a preferred embodiment, wall structure 36 is fabricated from a corrugated composite panel, however, any partition structure is considered within the scope of the present invention. Duct 30 is preferably generally vertically disposed and positioned such that a plurality of duct inlets 37A formed at the bottom thereof are positioned in spaced proximity to the lower inner surface of cylindrical housing 12. Similarly, duct outlets, referenced as 37B, are positioned in spaced proximity to the upper inner surface of cylindrical housing 12. The bottom end portion 34 of duct 30 may further be adapted with sidewall apertures 38 for improving exhaust flow dynamics through the duct. Sidewall apertures 38 may be formed for each flow passage, and may be staggered in height from one passage to the other as depicted in FIG. 4. The use of sidewall apertures 38 has been found significant in improving exhaust gas flow dynamics and the entrainment of water through duct inlets at the bottom 34 of duct 30.

As best illustrated in FIG. 3, exhaust gas and exhaust cooling water enter the inlet chamber 22 of muffler 10 via inlet 14 whereby angled lip 14A deflects at least a portion of the exhaust gas and cooling water upward toward the undersurface of inclined baffle 20 thereby increasing the effectiveness of sound attenuation by disrupting the incoming pressure waves. Under certain conditions wherein the engine is operating at relatively low RPM's, it is expected that exhaust gas cooling water will begin to pool on the housing floor within inlet chamber 22. As the water level rises and chokes the flow paths to the duct inlets, the exhaust gas velocity will naturally increase thereby causing entrainment of the water with the exhaust gas. It has been found that sidewall apertures 38 significantly enhance the entrainment of water within the exhaust gas flow stream. The exhaust gas and water exit duct 30 through outlets at the top 32 of duct 30 into outlet chamber 24 whereafter the exhaust gas and entrained cooling water are allowed to exit via muffler outlet 16. A muffler in accordance with the present invention may be fabricated from composite material, such as heat resistant fiberglass, or any other suitable material.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A muffler for a marine engine, said muffler comprising:

an elongate generally hollow cylindrical housing having first end forming an inlet and a second end forming an outlet;

an angularly inclined baffle contained within said housing and disposed between said housing inlet and outlet, said angularly inclined baffle dividing said housing into an inlet chamber disposed below said baffle, and an outlet chamber disposed above said baffle;

a non-circular duct projecting through said baffle and generally vertically disposed relative thereto, said duct having at least one lower inlet in communication with said inlet chamber and at least one upper outlet in communication with said outlet chamber.

2. A muffler for a marine engine according to claim 1, wherein said housing inlet further includes an inlet lip for deflecting at least a portion of exhaust gas upward toward said baffle, said lip angled upward in the direction of flow.

3. A muffler for a marine engine according to claim 1, wherein said duct defines a plurality of side wall apertures in proximity to said at least one lower inlet.

4. A muffler for a marine engine according to claim 1, wherein said duct defines a plurality of flow passages.

5. A muffler for a marine engine according to claim 1, wherein said baffle is generally planar.

6. A muffler for a marine engine according to claim 1, wherein said baffle is concave.

7. A muffler for a marine engine according to claim 1, wherein said baffle is convex.

8. A muffler for a marine engine, said muffler comprising:

an elongate, generally hollow cylindrical housing formed about a longitudinal axis, said housing having an inner surface and opposing ends defining an inlet and an outlet;

a baffle contained within said housing, said baffle having a peripheral edge in sealing engagement with said housing inner surface, said baffle inclined between said inlet and said outlet such that said housing is partitioned into an inlet chamber defined below said baffle, and an outlet chamber defined above said baffle;

a duct projecting through said baffle and generally vertically disposed within said housing, said duct having a lower portion defining at least one inlet in communication with said inlet chamber and an upper portion defining at least one outlet in communication with said outlet chamber, said at least one duct inlet being in spaced proximity with a lower portion of said housing, said at least one duct outlet being in spaced proximity with an upper portion of said housing;

said duct including a pair of spaced generally planar panes and a corrugated paned sandwiched therebetween so as to divide said duct into a plurality of generally triangular passageways;

said duct lower portion further defining at least one sidewall aperture.

9. A muffler for a marine engine according to claim 8, wherein said housing inlet includes an upwardly angularly disposed inlet lip.

10. A muffler for a marine engine according to claim 8, wherein said duct lower portion defines a plurality of side wall apertures.

11. A muffler for a marine engine according to claim 8, wherein said duct includes an internal wall structure partitioning said duct into a plurality of flow passages.

12. A muffler for a marine engine according to claim 8, wherein said baffle is generally planar.

13. A muffler for a marine engine according to claim 8, wherein said baffle is concave.

14. A muffler for a marine engine according to claim 8, wherein said baffle is convex.

* * * * *